US007266867B2

(12) United States Patent
Shen et al.

(10) Patent No.: US 7,266,867 B2
(45) Date of Patent: Sep. 11, 2007

(54) METHOD FOR LAMINATING ELECTRO-MECHANICAL STRUCTURES

(75) Inventors: Jun Shen, Phoenix, AZ (US); Cheng Ping Wei, Gilbert, AZ (US); Mark Goranson, Mesa, AZ (US)

(73) Assignee: Schneider Electric Industries SAS (FR)

( * ) Notice: Subject to any disclaimer, the term of this patent is extended or adjusted under 35 U.S.C. 154(b) by 433 days.

(21) Appl. No.: 10/664,404

(22) Filed: Sep. 17, 2003

(65) Prior Publication Data

US 2004/0183633 A1 Sep. 23, 2004

Related U.S. Application Data

(60) Provisional application No. 60/411,345, filed on Sep. 18, 2002.

(51) Int. Cl.
*H04R 17/00* (2006.01)

(52) U.S. Cl. ..... 29/25.35; 29/25.41; 29/25.42; 29/622; 29/600; 156/250; 310/309; 200/181; 335/78

(58) Field of Classification Search ..... 29/600, 29/602.1, 25.35–25.42, 610.1, 622, 825; 336/232, 223, 200, 365; 257/686, 777, 434, 257/704; 73/514.16, 514.36; 310/309, 311; 156/250, 292; 438/52
See application file for complete search history.

(56) References Cited

U.S. PATENT DOCUMENTS 4,065,677 A 12/1977 Micheron et al.
4,461,968 A 7/1984 Kolm et al.
4,496,211 A 1/1985 Daniel
4,570,139 A 2/1986 Kroll
4,755,706 A 7/1988 Harnden, Jr. et al.
4,979,159 A 12/1990 Tsuruoka et al.
5,016,978 A 5/1991 Fargette et al.
5,048,912 A 9/1991 Kunikane et al.
5,072,228 A 12/1991 Kuwahara
5,398,011 A 3/1995 Kimura et al.
5,430,421 A 7/1995 Bornand et al.
5,454,904 A 10/1995 Ghezzo et al.
5,472,539 A 12/1995 Saia et al.
5,475,353 A 12/1995 Roshen et al.

(Continued)

FOREIGN PATENT DOCUMENTS

DE 198 20 821 C1 12/1999

(Continued)

OTHER PUBLICATIONS

International Search Report for International Application No. PCT/US03/29254 mailed on Mar. 5, 2004.
Richard P. Feymann, "There's Plenty of Room at the Bottom", Dec. 29, 1959, pp. 1-12, Internet Source: http://222.zyvex.com/nanotech/feynman.html.

(Continued)

*Primary Examiner*—Minh Trinh
(74) *Attorney, Agent, or Firm*—Sterne, Kessler, Goldstein & Fox PLLC

(57) ABSTRACT

Methods and systems of assembling and making laminated electro-mechanical systems and structures are described. A plurality of structural layers are formed that include at least one structural layer having a movable element formed therein. The plurality of structural layers are stacked and aligned into a stack. Each structural layer in the stack is attached to an adjacent structural layer of the stack.

26 Claims, 9 Drawing Sheets

U.S. PATENT DOCUMENTS

| | | | | |
|---|---|---|---|---|
| 5,557,132 | A | 9/1996 | Takahashi | |
| 5,629,918 | A | 5/1997 | Ho et al. | |
| 5,696,619 | A | 12/1997 | Knipe et al. | |
| 5,784,190 | A | 7/1998 | Worley | |
| 5,818,316 | A | 10/1998 | Shen et al. | |
| 5,838,847 | A | 11/1998 | Pan et al. | |
| 5,847,631 | A | 12/1998 | Taylor et al. | |
| 5,898,515 | A | 4/1999 | Furlani et al. | |
| 5,945,898 | A | 8/1999 | Judy et al. | |
| 5,982,554 | A | 11/1999 | Goldstein et al. | |
| 6,016,092 | A | 1/2000 | Qiu et al. | |
| 6,016,095 | A | 1/2000 | Herbert | |
| 6,028,689 | A | 2/2000 | Michalicek et al. | |
| 6,046,659 | A * | 4/2000 | Loo et al. | 333/262 |
| 6,078,016 | A | 6/2000 | Yoshikawa et al. | |
| 6,084,281 | A | 7/2000 | Fullin et al. | |
| 6,094,116 | A | 7/2000 | Tai et al. | |
| 6,094,293 | A | 7/2000 | Yokoyama et al. | |
| 6,115,231 | A | 9/2000 | Shirakawa | |
| 6,124,650 | A | 9/2000 | Bishop et al. | |
| 6,143,997 | A | 11/2000 | Feng et al. | |
| 6,160,230 | A | 12/2000 | McMillan et al. | |
| 6,191,671 | B1 | 2/2001 | Schlaak et al. | |
| 6,297,072 | B1 | 10/2001 | Tilmans et al. | |
| 6,384,353 | B1 * | 5/2002 | Huang et al. | 200/181 |
| 6,410,360 | B1 | 6/2002 | Steenberge | |
| 6,495,895 | B1 * | 12/2002 | Peterson et al. | 257/434 |
| 6,511,894 | B2 | 1/2003 | Song | |
| 6,621,390 | B2 | 9/2003 | Song et al. | |
| 6,633,212 | B1 * | 10/2003 | Ruan et al. | 335/78 |
| 6,794,965 | B2 | 9/2004 | Shen et al. | |
| 7,102,480 | B2 * | 9/2006 | Bergstedt et al. | 336/232 |
| 2002/0196110 | A1 | 12/2002 | Vaitkus et al. | |
| 2005/0057329 | A1 | 3/2005 | Shen et al. | |

FOREIGN PATENT DOCUMENTS

| | | | |
|---|---|---|---|
| DE | 100 31 569 | A1 | 2/2001 |
| EP | 0 452 012 | A2 | 10/1991 |
| EP | 0 452 012 | A3 | 10/1991 |
| EP | 0 685 864 | A1 | 12/1995 |
| EP | 0 709 911 | A2 | 5/1996 |
| EP | 0 780 858 | A1 | 6/1997 |
| EP | 0 869 519 | A1 | 10/1998 |
| EP | 0 887 879 | A1 | 12/1998 |
| FR | 2 572 546 | | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/34269 | | 8/1998 |
| WO | WO 99/27548 | | 6/1999 |
| WO | WO 01/57899 | A1 | 8/2001 |
| WO | WO 01/84211 | A2 | 11/2001 |

OTHER PUBLICATIONS

E. Fullin, J. Gobet, H.A.C. Tilmans, and J. Bergvist, "A New Basic Technology for Magnetic Micro-Acuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC to C Band", Series RF 341, product information from Teledyne Relays, 1998.

M. Ruan et al., "Latching Microelectromagnetic Relays" , Sensors and Actuators A 91 (Jul. 15, 2001), Copyright 2001 Elsevier Science B.V., pp. 346-350.

Xi-Qing Sun, K.R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, Jun. 1998, pp. 304-307.

John A. Wright, Yu-Chong Tai, and Shih-Chia Chang, "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

English-Language Abstract of DE 10031569, published Feb. 1, 2001, 1 page.

English-Language Abstract of DE 19820821, published Dec. 16, 1999, 1 page.

English-Language Abstract of EP 0780858, published Jun. 25, 1997, 1 page.

English-Language Abstract of EP 0869519, published Oct. 7, 1998, 1 page.

English-Language Abstract of FR 2572546, published May 2, 1986, 1 page.

English-Language Abstract of JP 4275519, published Oct. 1, 1992, 1 page.

English-Language Abstract of JP 6251684, published Sep. 9, 1994, 1 page.

English-Language Abstract of JP 54161952, published Dec. 22, 1979, 1 page.

English-Language Abstract of WO 9927548, published Jun. 3, 1999, 1 page.

* cited by examiner

FIG. 1B
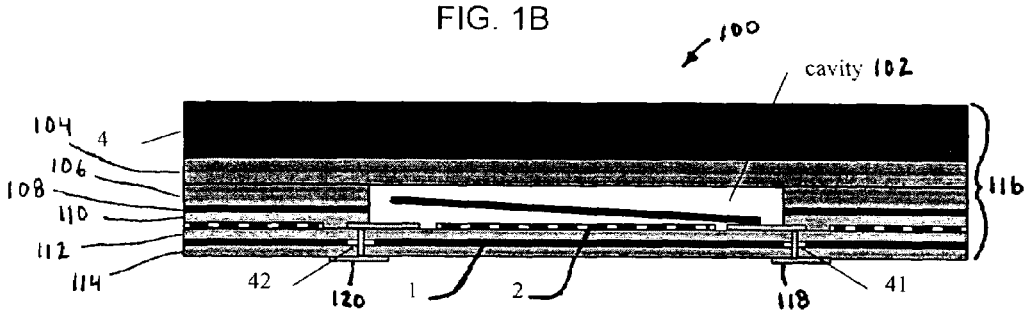
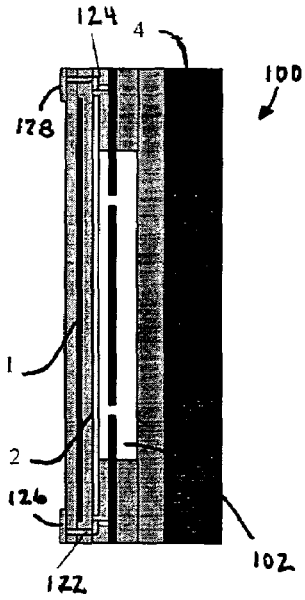
FIG. 1C
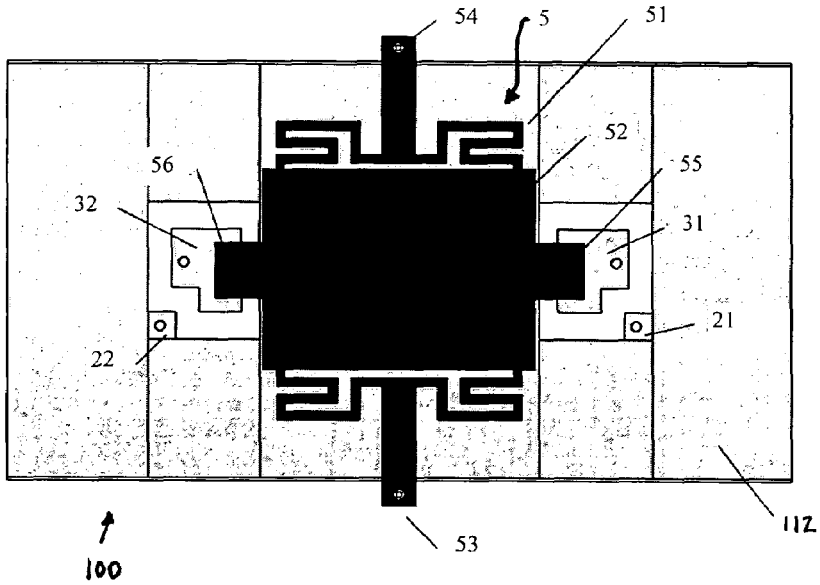
FIG. 1A

METHOD FOR LAMINATING ELECTRO-MECHANICAL STRUCTURES

CROSS-REFERENCE TO RELATED APPLICATIONS

This application claims priority to U.S. provisional Application No. 60/411,345, filed Sep. 18, 2002, which is incorporated herein by reference in its entirety.

BACKGROUND OF THE INVENTION

1. Field of the Invention

The present invention relates to electro-mechanical systems. More specifically, the present invention relates to the assembly of electro-mechanical systems by lamination of layers to form magnetic latching switches, and the like.

2. Background Art

Switches are typically electrically controlled two-state devices that open and close contacts to effect operation of devices in an electrical or optical circuit. Relays, for example, typically function as switches that activate or de-activate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

Although the earliest relays were mechanical or solid-state devices, recent developments in micro-electro-mechanical systems (MEMS) technologies and microelectronics manufacturing have made micro-electrostatic and micro-magnetic relays possible. Such micro-magnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micro-magnetic relays may degrade or break over time.

Non-latching micro-magnetic relays are known. The relay includes a permanent magnet and an electromagnet for generating a magnetic field that intermittently opposes the field generated by the permanent magnet. The relay must consume power in the electromagnet to maintain at least one of the output states. Moreover, the power required to generate the opposing field would be significant, thus making the relay less desirable for use in space, portable electronics, and other applications that demand low power consumption.

The basic elements of a latching micro-magnetic switch include a permanent magnet, a substrate, a coil, and a cantilever at least partially made of soft magnetic materials. In its optimal configuration, the permanent magnet produces a static magnetic field that is relatively perpendicular to the horizontal plane of the cantilever. However, the magnetic field lines produced by a permanent magnet with a typical regular shape (disk, square, etc.) are not necessarily perpendicular to a plane, especially at the edge of the magnet. Then, any horizontal component of the magnetic field due to the permanent magnet can either eliminate one of the bistable states, or greatly increase the current that is needed to switch the cantilever from one state to the other. Careful alignment of the permanent magnet relative to the cantilever so as to locate the cantilever in the right spot of the permanent magnet field (usually near the center) will permit bi-stability and minimize switching current. Nevertheless, high-volume production of the switch can become difficult and costly if the alignment error tolerance is small.

What is desired are electro-mechanical devices, including latching micro-magnetic switches, that are reliable, simple in design, low-cost and easy to manufacture. Hence, what is further desired is improved methods and systems for manufacturing electro-mechanical devices.

BRIEF SUMMARY OF THE INVENTION

Methods and systems for assembling and making laminated electro-mechanical systems, structures, and devices are described herein. In a first aspect, a system and method of assembling an electro-mechanical structure is provided. A stack of structural layers is aligned. The stack includes at least one structural layer having a movable element formed therein. Each structural layer of the stack is attached to an adjacent structural layer of the stack.

Numerous types of structural layers may be positioned in the stack. In an aspect, a structural layer that includes a permanent magnet is positioned in the stack. In another aspect, a structural layer that includes a high permeability magnetic material is positioned in the stack. In another aspect, a structural layer that includes at least a portion of an electromagnet is positioned in the stack. In another aspect, a structural layer that includes at least one electrical contact area formed thereon is positioned in the stack. Further structural layer types may be positioned in the stack.

The movable element can be a micro-machined movable element. In a further aspect, a first structural layer that includes the micro-machined movable element is positioned in the stack.

In a further aspect, a cavity may be formed in the stack by positioning the structural layer having the movable element between a second structural layer having an opening therethrough and a third structural layer having an opening therethrough. The cavity may be formed such that the movable element is capable of moving in the cavity during operation of the movable element.

In a still further aspect, the plurality of structural layers are formed.

In another aspect, one or more laminated electro-mechanical structures are assembled or made according to the methods and systems described herein. These structures form devices that can be vertically stacked upon one another and/or laterally spaced apart. In either case, the devices can be electrically and/or optically coupled to form a circuit. Alternatively, they can be coupled (electrically and/or optically) to other discrete or integrated circuits.

These and other objects, advantages and features will become readily apparent in view of the following detailed description of the invention.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

FIGS. 1A-1C show views of a laminated electro-mechanical system, according to an embodiment of the present invention.

Figure 2A:
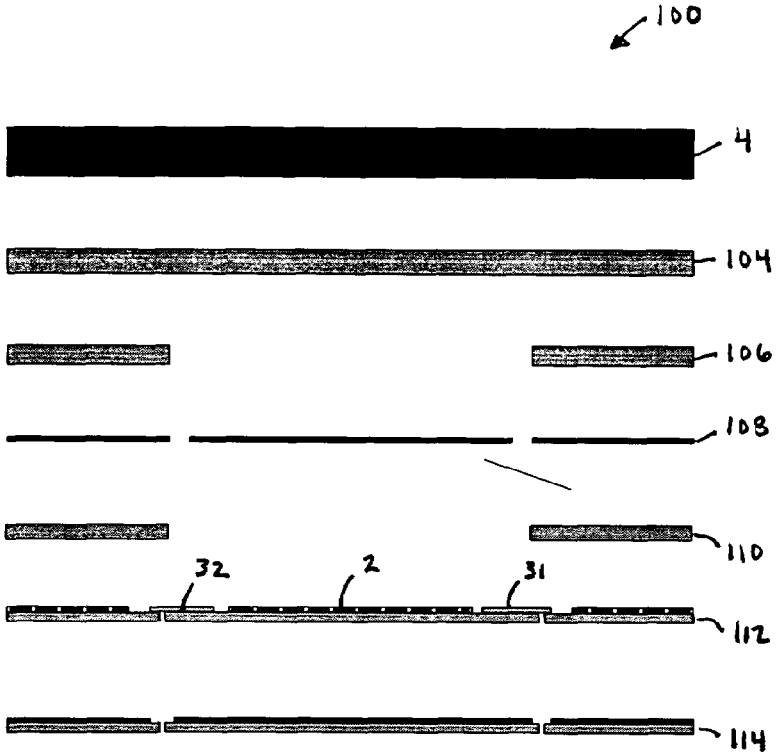
FIG. 2A shows side views of separated layers of the laminated electro-mechanical system shown in FIGS. 1A-1C.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, laminated electro-mechanical and MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that the manufacturing techniques described herein could be used to create mechanical relays, optical relays, any other switching device, and other component types. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, transmission line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal suicides are examples of other conductors.

The terms contact and via, both refer to structures for electrical connection of conductors from different interconnect levels. These terms are sometimes used in the art to describe both an opening in an insulator in which the structure will be completed, and the completed structure itself For purposes of this disclosure contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micro-magnetic latching switch is further described in international patent publications WO0157899 (titled Electronically Switching Latching Micro-magnetic Relay And Method of Operating Same), and WO0184211 (titled Electronically Micro-magnetic latching switches and Method of Operating Same), to Shen et al. These patent publications provide a thorough background on micro-magnetic latching switches and are incorporated herein by reference in their entirety. Moreover, the details of the switches disclosed in WO0157899 and WO0184211 are applicable to implement the switch embodiments of the present invention as described below.

Laminated Electro-Mechanical Systems

The present invention relates to laminated electro-mechanical systems (LEMS) and structures. In the laminated electro-mechanical systems and structures of the present invention, various layers of materials with predefined patterns are formed. The layers are aligned relative to each other, and laminated together or built-up, to form a multi-layer structure or stack. Movable mechanical elements can be created in one or more layers of the stack. A movable element is provided with space to move in the stack by creating a cavity in the stack. To create a cavity, layers with openings are aligned on one or both sides of the layer having the movable element. The movable elements are allowed to move freely in the formed cavity after lamination together of the various layers.

The present invention may include any type of actuation mechanism to control movement of the movable mechanical elements. Example applicable actuation mechanisms include electrical, electrostatic, magnetic, thermal, and piezoelectric actuation mechanisms. Note that for illustrative purposes, a micro-mechanical latching switch having a magnetic actuation mechanism is described herein as being made as a laminated electro-mechanical system or structure. It is to be understood from the teachings herein that switches having other actuation mechanisms can also be made as a laminated electro-mechanical system or structure.

The laminated electro-mechanical systems and structures of the present invention provide numerous advantages. An advantage of the present invention includes low cost. The material(s) used for the layers of the present invention are conventional materials that are relatively inexpensive. Conventional techniques may be used to form patterns in the layers, including screen-printing, etching (e.g., photolithography or chemical), ink jet printing, and other techniques. Furthermore, conventional lamination techniques can be used to attach the layers together.

Another advantage of the present invention is that it is relatively easy to produce. The layers of the present invention are formed. The layers are then merely aligned and attached to each other. Complicated attachment mechanisms are not required. As described above, conventional techniques may be used to attach the layers. Furthermore, laminated electro-mechanical systems and structures may be made in large sheets that include large numbers of the devices to provide economies of scale.

Another advantage of the present invention is an ease in integration of laminated electro-mechanical systems and structures with other electronic components (e.g., inductors, capacitors, resistors, antenna patterns, filters). The other electronic components may be formed on one or more of the layers when they are preformed, prior to placement in the stack, for example.

Still another advantage of the present invention is an ease in scaling up or down the dimensions of the laminated electro-mechanical systems and structures to better handle different levels of power. The laminated electro-mechanical systems and structures may be scaled down to the level of micro-machined structures and devices, for example. Such micro-machined structures and devices require small amounts of power. The laminated electro-mechanical systems and structures may also be scaled up to larger sized structures and devices.

Assembling Laminated Electro-Mechanical Structures According to the Present Invention Embodiments for making and assembling laminated electro-mechanical systems and structures according to the present invention are described in detail as follows. These implementations are described herein for illustrative purposes, and are not limiting. The laminated electro-mechanical systems and structures of the present invention, as described in this section, can be assembled in alternative ways, as would be apparent to persons skilled in the relevant art(s) from the teachings herein.

FIGS. 1A-1C show views of a laminated electro-mechanical system 100, according to an embodiment of the present invention. FIG. 1A shows a plan view of laminated electro-mechanical system 100. FIGS. 1B and 1C show cross-sectional views of laminated electro-mechanical system 100. For illustrative purposes, laminated electro-mechanical system 100 is shown as including a micro-magnetic latching switch. However, it is noted that the present invention as described herein is also applicable fabrication of latching switches with other actuation mechanisms, and to fabrication of other larger scale and micro-machined device types.

As shown in FIGS. 1A-1C, laminated electro-mechanical system 100 includes a high-permeability (e.g., permalloy) layer 1, an electromagnet or coil 2 having contacts 21 and 22, bottom contacts 31 and 32, a permanent magnet 4, a cantilever assembly 5, and further lamination layers. Cantilever assembly 5 includes contacts 53 and 54, a cantilever body 52 (e.g., made of a soft magnetic material such as a permalloy), and contact tips 55 and 56, and is supported by torsion flexures 51. Cantilever body 52 is a movable element that is positioned inside a cavity 102 so that it can toggle freely between contacts 31 and 32 during operation of the latching switch. Example operation of the latching switch is further described above.

Figure 2B:
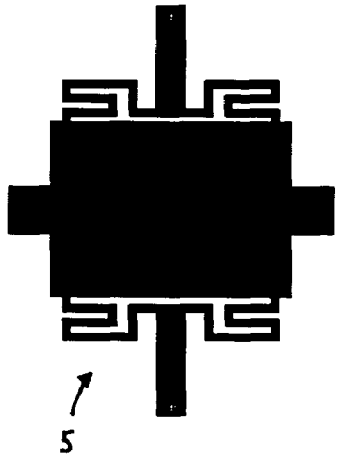
FIG. 2B shows a top view of the cantilever assembly of the laminated electro-mechanical system shown in FIGS. 1A-1C.

To fabricate the latching switch shown in FIGS. 1A-1C, various patterns and openings are first defined and formed on the structural lamination layers or built up with other materials. These structural layers are shown in FIGS. 1A-1C, and are also shown in FIG. 2A, where laminated electro-mechanical system 100 is shown in exploded form. As shown in FIGS. 1B and 2A, laminated electro-mechanical system 100 includes a structural layer formed substantially by permanent magnet 4, a first substrate layer 104, a first spacer layer 106, a movable element layer 108, a second spacer layer 110, a coil layer 112, and a second substrate layer 114. FIG. 2B shows a plan view of cantilever assembly 5.

The structural layers can be formed from a variety of materials. For example, in an embodiment, the structural layers can be formed from thin films that are capable of at least some flexing, and have large surface areas. Alternatively, structural layers can be formed from other materials. The structural layers can be electrically conductive or non-conductive. For example, the structural layers can be formed from inorganic or organic substrate materials, including plastics, glass, polymers, dielectric materials, etc. Example organic substrate materials include "BT," which includes a resin called bis-maleimide triazine, "FR-4," which is a fire-retardant epoxy resin-glass cloth laminate material, and/or other materials. In electrically conductive structural layer embodiments, structural layers can be formed from a metal or combination of metals/alloy, or from other electrically conductive materials.

As shown in FIG. 1B, the structural layers are aligned and stacked together to form a stack 116. The structural layers are attached to each other in the stack with an adhesive material (not shown). The adhesive material may be an adhesive tape, or an interfacial glue layer, such as an epoxy (e.g. a B-stage epoxy) applied/located between the structural layers. If the adhesive material requires curing, such as thermal curing, stack 116 can be heated to a suitable temperature to cure the adhesive material, and attach the structural layers together.

As shown in FIGS. 1B and 1C, a cavity 102 is formed aligning the openings through first and second spacer layers 106 and 110 on either side of movable element layer 108. Cavity 102 allows the movable element of movable element layer 108 (e.g., cantilever body 52) to move freely to contact one or more electrical contacts, such as contacts 31 and 32 shown in FIG. 1A. Contacts 31 and 32 are formed on coil layer 112 in the example of FIGS. 1A-1C.

One or more vias may be formed in structural layers to allow electrical contact between elements in system 100 and elements exterior to system 100. As shown in FIG. 1B, for example, vias 41 and 42 electrically couple contact areas 31 and 32, respectively, to contact pads 118 and 120 formed on a surface of second substrate layer 114. Furthermore, as shown in FIG. 1C, vias 122 and 124 electrically couple contacts 53 and 54 to contact pads 126 and 128 formed on a surface of second substrate layer 114. Vias may be formed in any number of one or more structural layers. Vias through multiple layers can be aligned to allow electrical connections between any structural layers.

Note that although a single latching switch is shown in the embodiment of FIGS. 1A-1C, it should be understood that multiple micro-mechanical devices can be patterned on the lamination layers and batch fabricated. The multiple micro-mechanical devices can be left together, or can be separated by cutting.

Figure 3A:
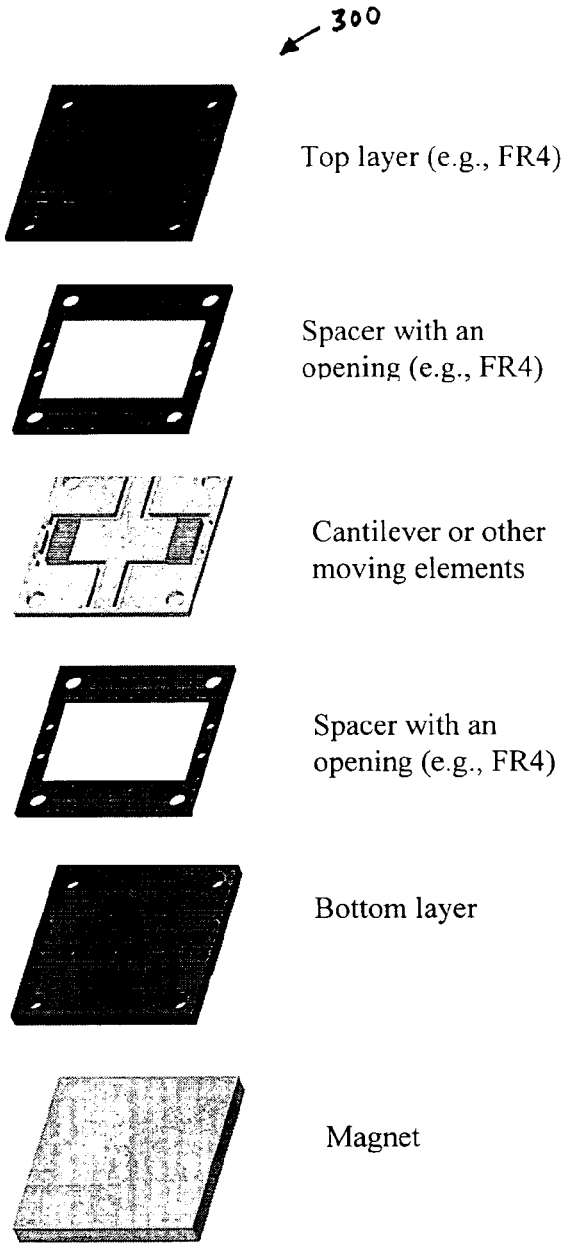
FIG. 3A illustrates separated layers of a laminated electro-mechanical system that may be assembled to form a cavity for a movable element, according to an embodiment of the present invention.
Figure 3B:
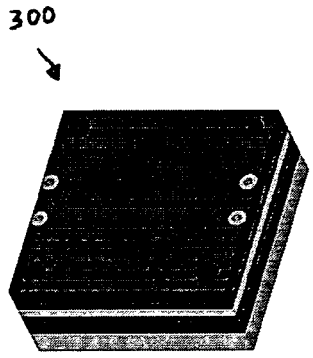
FIG. 3B illustrates the attachment together of the separated layers shown in FIG. 3A, according to an example embodiment of the present invention.

FIG. 3A illustrates separated layers of a laminated electro-mechanical system 300 that may be assembled to form a cavity for a movable element, according to a further example embodiment of the present invention. FIG. 3B illustrates the attachment together of the separated layers shown in FIG. 3A to form laminated electro-mechanical system 300, according to an example embodiment of the present invention.

Figure 7A:
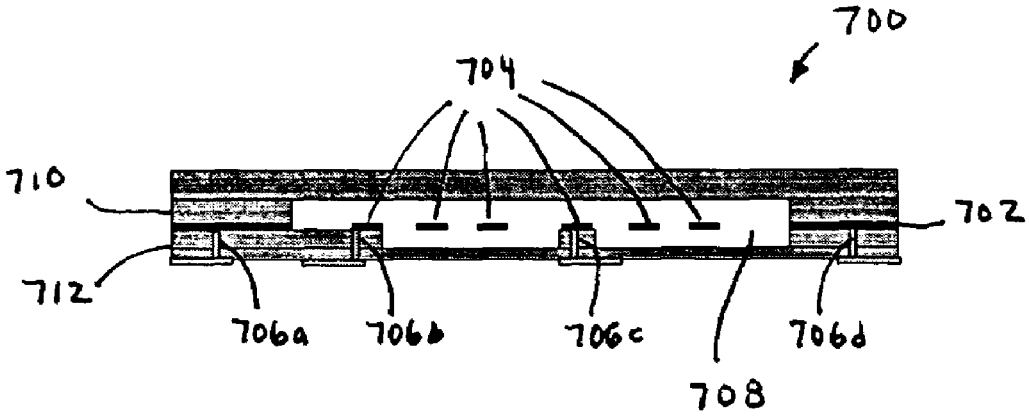
FIGS. 7A and 7B illustrate side and top views of an inductor layer that can be used in a laminated electro-mechanical system, according to an example embodiment of the present invention.
Figure 7B:
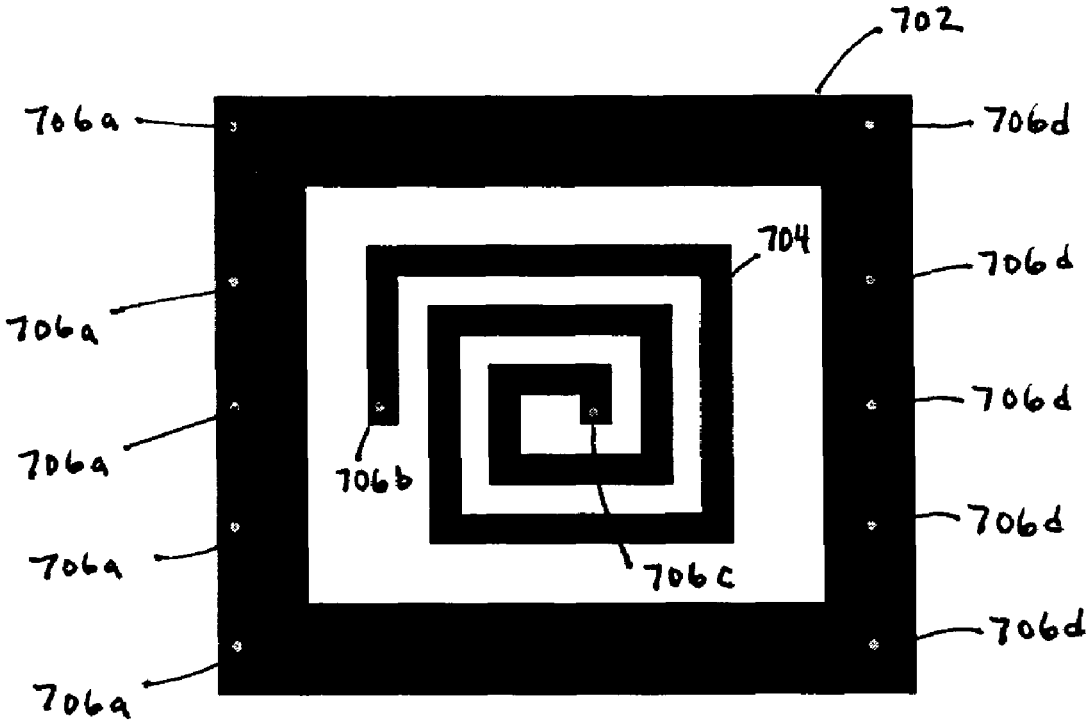

Note that various electronic devices or components, including switches, inductors, capacitors, resistors, antenna patterns, and others, can also be fabricated similarly to the processes described herein. For example, FIGS. 7A and 7B illustrate a laminated electro-mechanical system 700 that includes a structural layer having an inductor 704 and ground plane 702 present. As shown in FIG. 7A, inductor 704 is located in a cavity 708. The open portion of cavity 708 is formed by first and second spacer layers 710 and 712. As shown in FIG. 7B, inductor 704 is formed as a planar coil. Ground plane 702 is electrically isolated from, and surrounds inductor 704 in the plane of the structural layer in which they reside. A plurality of vias 706*a*-706*d* are used to electrically couple ends of inductor 704, and portions of ground plane 704, to externally available contact pads on one or more surfaces of laminated electro-mechanical system 700. As shown in FIG. 7A, portions of inductor 704 are suspended. In such a suspended configuration, inductor 704 has a high quality factor. Furthermore, the planar configuration for inductor 704 reduces the cost of inductor 704.

Figure 4:
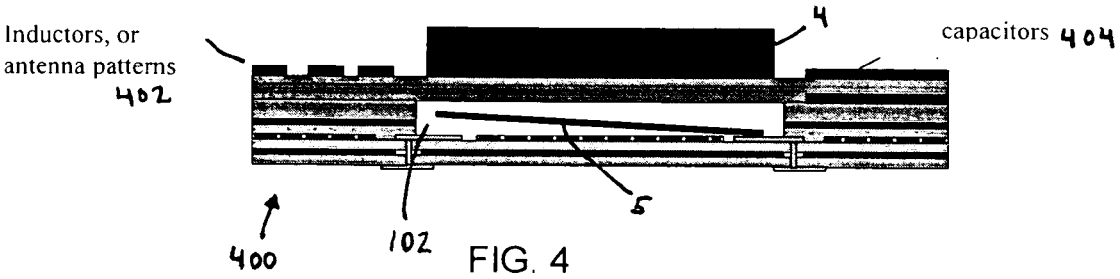
FIG. 4 illustrates a structure formed by the assembly process of the present invention that integrates switches with other components.

Furthermore, various electronic devices or components, including switches, inductors, capacitors, resistors, antenna patterns, and others may be integrated with embodiments of the present invention. For example, FIG. 4 illustrates a laminated electro-mechanical system 400 formed by the lamination assembly process of the present invention, that integrates an inductor or antenna pattern 402 and capacitors 404. The electrical contact areas of a latching switch of system 400 may be electrically coupled to the electrical components integrated therewith, by one or more vias, conductor lines, and/or other ways, to form a circuit on the same structure. For example, embodiments of the present invention may be combined with electrical components and/or devices to create reconfigurable filters, reconfigurable antennas, and other devices. Embodiments of the present invention may also be used with liquid crystal displays, and other display types. The laminated electro-mechanical systems and structures can be electrically and/or optically coupled with the electrical components and devices, for example.

Transmission lines, such as radio frequency transmission lines, can be accommodated in a laminated electro-mechanical system of the present invention. For example, in an embodiment, a radio frequency (RF) switch formed in a laminated electro-mechanical system of the present invention can be coupled to a radio frequency transmission line having a pair of conductive lines or traces. In one embodiment, the conductive lines or traces of the radio frequency transmission line can be formed in parallel on a single structural layer of a stack. In another embodiment, a first conductive line or trace of the radio frequency transmission line can be formed on a first structural layer of a stack, while a second conductive line or trace of the radio frequency transmission line can be formed on a second structural layer of the stack. An insulating or electrically non-conducting structural layer can be positioned in the stack between the first and second conductive lines or traces.

Figure 5:
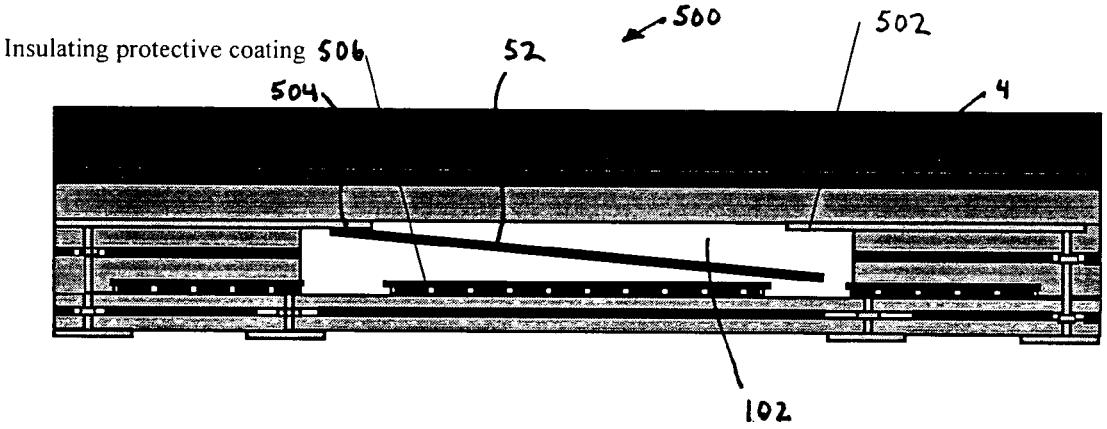
FIG. 5 illustrates a structure formed by the assembly process of the present invention that integrates switches with contacts on a top inner surface.

Note that contact areas for movable elements in laminated electro-mechanical systems 100, 300, and 400 may be positioned in various locations. For example FIG. 5 illustrates a structure or system 500 formed by the assembly process of the present invention that integrates a latching switch. Cantilever body 52 toggles to make contact with contact areas 502 and 504 on a top inner surface of cavity 102. Furthermore, contact area may be located on top and bottom surface in a single system.

Note that coil 2 can be formed on both the top and bottom sides of cantilever body 52. Furthermore, solenoid coils can be fabricated by connecting coil lines on two layers. As shown in FIG. 5, a coil 2 may be coated with an insulator 506 to protect the coil 2 from contact with cantilever body 52.

Furthermore, a movable element can be formed that is capable of movement in the plane of the structural layer in which it is formed. In other words, the movable element may be formed to have a degree of freedom that is coplanar with the plane of the structural layer in which it resides, as opposed to the movable element shown in FIG. 5, which has a degree of freedom that is not coplanar with the plane of the structural layer in which it resides.

Figure 12A:
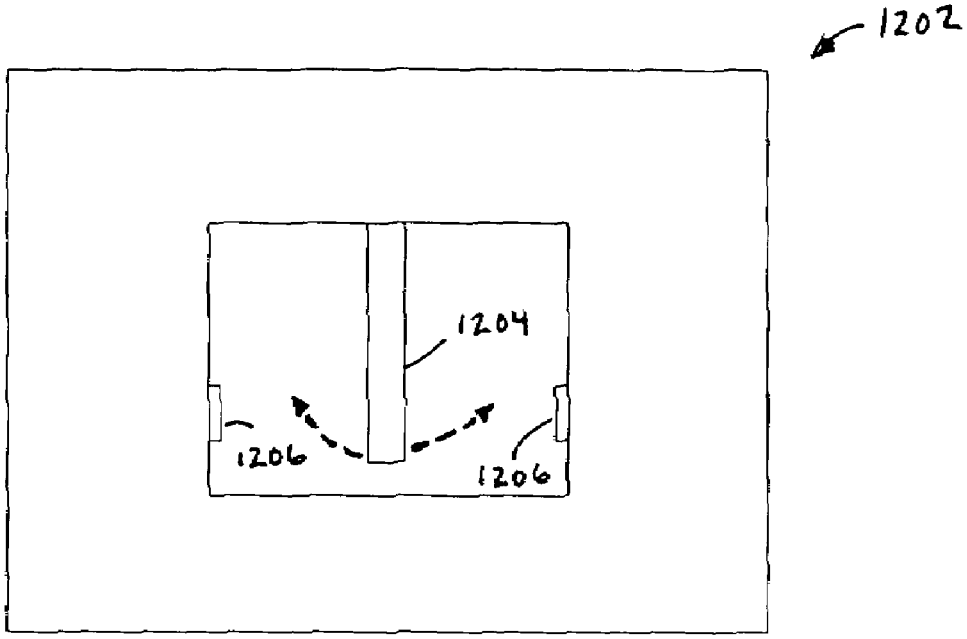
FIG. 12A shows an example movable element layer that includes a movable element capable of movement laterally in the movable element layer, according to an embodiment of the present invention.
Figure 12B:
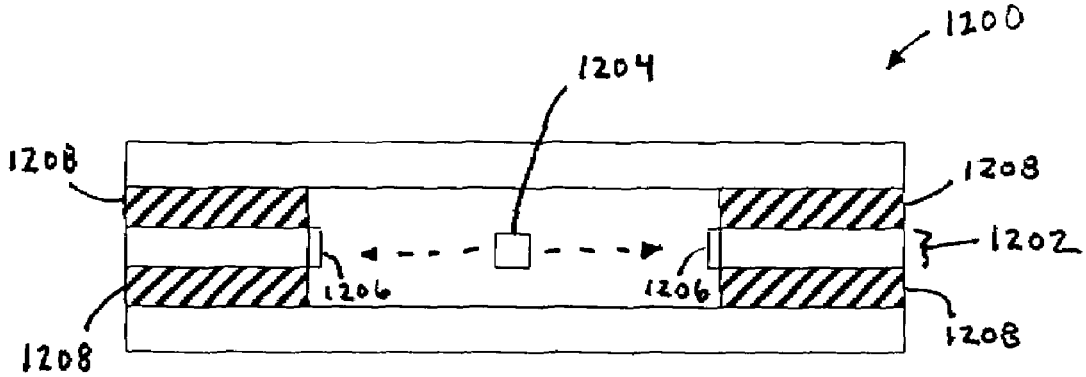
FIG. 12B shows a cross-sectional view of a laminated electro-mechanical system that includes the movable element layer shown in FIG. 12A, according to an embodiment of the present invention.

For example, FIG. 12A shows an example movable element layer 1202 that includes a movable element 1204 that is capable of movement laterally in movable element layer 1202. Movable element 1204 is capable of moving to make contact with one or more contact areas 1206. FIG. 12B shows a cross-sectional view of a laminated electro-mechanical system 1200 that includes movable element layer 1202. As shown in FIG. 12B, magnets and/or coils 1208 are used to actuate movement of movable element 1204 in the plane of movable element layer 1202. Embodiments such as that shown in FIGS. 12A and 12B may have reduced cavity size requirements than those in which the movable element is capable of movement outside of the plane of the structural layer in which the movable element resides.

In an embodiment, structural layers can be configured in a stack of a laminated electro-mechanical system to provide for hermetic sealing of elements of a portion or all of the stack. For example, in an embodiment, it may be desired to hermetically seal a moveable element and related contact(s) within a stack 116, such as those of cantilever assembly 5 shown in FIGS. 1A-1C, 2A, and 2B. In such an embodiment, one or more structural layers above and below cantilever assembly 5 can be formed from materials that are substantially impervious to moisture and/or other environmental hazards. For example, one or more of layers 104, 106, 110, 112, and 114 can be made from a glass material, or other suitable hermetic sealing material mentioned elsewhere herein, or otherwise known. In such a manner, for example, a hermetically sealed cavity 102 can be formed. Hermetically sealing structural layers can be formed around any elements in a stack 116 requiring to be hermetically sealed, including moveable elements, related contacts, coils, circuit elements (e.g., capacitors, resistors, inductors), magnets, and/or other elements. Note that any elements/layers of the laminated electro-mechanical system, including coils, permalloy layers, contacts, circuit elements, or other layers/elements of the device, can be formed on the hermetically sealing structural layers.

Figure 6:
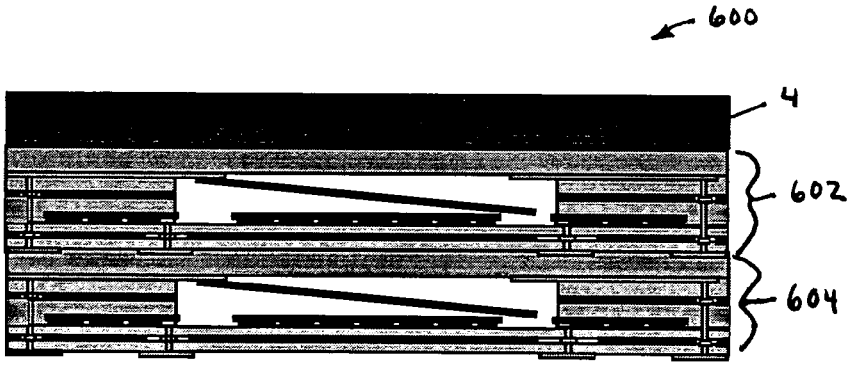
FIG. 6 illustrates a structure formed by the assembly process of the present invention that includes multiple switches and/or other elements integrated vertically, according to an embodiment of the present invention.

Note that multiple laminated electro-mechanical devices may be made or assembled according to the present invention in a vertically spaced or stacked configuration, or in a laterally spaced or co-planar configuration. For example, FIG. 6 illustrates a structure 600 formed by the assembly process of the present invention that includes multiple micro-mechanical systems 602 that are stacked or integrated vertically, according to an embodiment of the present invention. Multiple stacks of switches and other elements (inductors, capacitors, etc.) can be integrated vertically and laterally.

Figure 8:
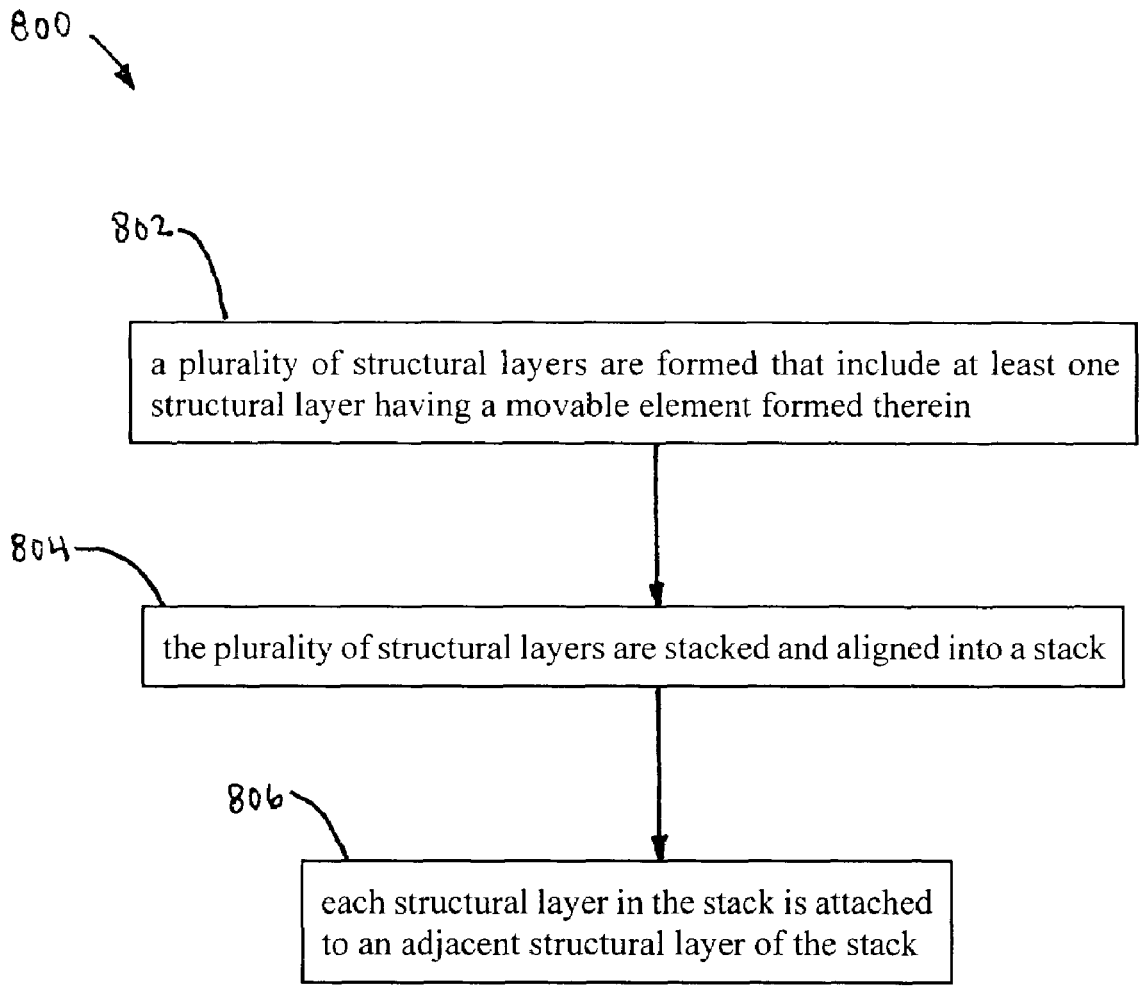
FIG. 8 shows a flowchart for making or assembling laminated electro-mechanical structures, according to an example embodiment of the present invention.

FIG. 8 shows a flowchart 800 providing steps for making micro-machined structures of the present invention. The steps of FIG. 8 do not necessarily have to occur in the order shown, as will be apparent to persons skilled in the relevant art(s) based on the teachings herein.

As described herein, numerous electrical and mechanical device types may be made according to the laminated electro-mechanical systems and structures of the present invention. These devices can be made in a wide range of sizes, including small-scale micro-mechanical devices and larger scale devices. These devices can also be made to include movable elements, such as latching switches. The following sections are provided to detail structure and operation of an example micro-mechanical latching switch that may be formed according to the laminated electro-mechanical systems and structures of the present invention. However, note that this description is provided for illustrative purposes, and the present invention is not limited to the embodiments shown therein. As described above, the present invention is applicable to numerous device types.

Overview of a Latching Switch

Figure 9A:
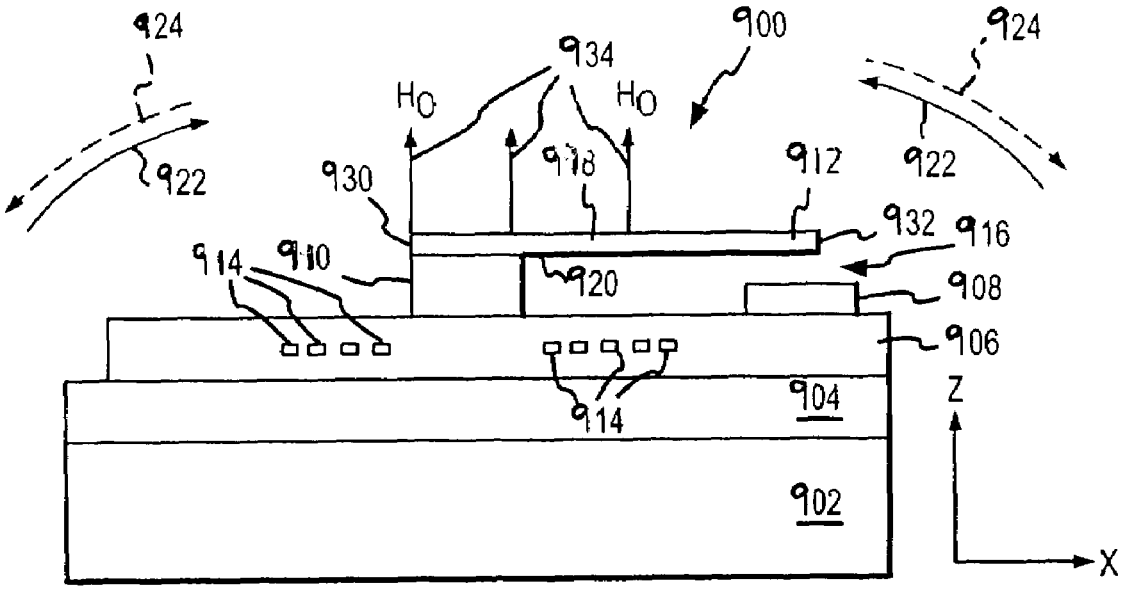
FIGS. 9A and 9B are side and top views, respectively, of an exemplary embodiment of a switch.
Figure 9B:
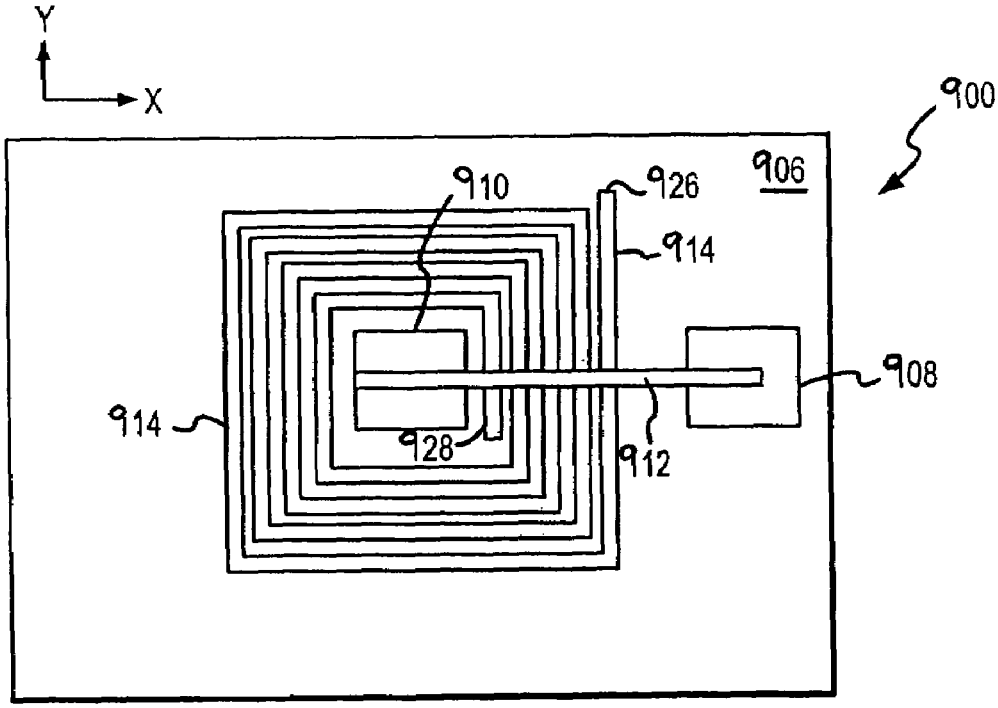

FIGS. 9A and 9B show side and top views, respectively, of a latching switch. The terms switch and device are used herein interchangeably to described the structure of the present invention. With reference to FIGS. 9A and 9B, an exemplary latching relay 900 suitably includes a magnet 902, a substrate 904, an insulating layer 906 housing a conductor 914, a contact 908 and a cantilever (moveable element) 912 positioned or supported above substrate by a staging layer 910.

Magnet 902 is any type of magnet such as a permanent magnet, an electromagnet, or any other type of magnet capable of generating a magnetic field H0 934, as described more fully below. By way of example and not limitation, the magnet 902 can be a model 59-P09213T001 magnet available from the Dexter Magnetic Technologies corporation of Fremont, Calif., although of course other types of magnets could be used. Magnetic field 934 can be generated in any manner and with any magnitude, such as from about 1 Oersted to 104 Oersted or more. The strength of the field depends on the force required to hold the cantilever in a given state, and thus is implementation dependent. In the exemplary embodiment shown in FIG. 9A, magnetic field H0 934 can be generated approximately parallel to the Z axis and with a magnitude on the order of about 370 Oersted, although other embodiments will use varying orientations and magnitudes for magnetic field 934. In various embodiments, a single magnet 902 can be used in conjunction with a number of relays 900 sharing a common substrate 904.

Substrate 904 is formed of any type of substrate material such as silicon, gallium arsenide, glass, plastic, metal or any other substrate material. In various embodiments, substrate 904 can be coated with an insulating material (such as an oxide) and planarized or otherwise made flat. In various embodiments, a number of latching relays 900 can share a single substrate 904. Alternatively, other devices (such as transistors, diodes, or other electronic devices) could be formed upon substrate 904 along with one or more relays 900 using, for example, conventional integrated circuit manufacturing techniques. Alternatively, magnet 902 could be used as a substrate and the additional components discussed below could be formed directly on magnet 902. In such embodiments, a separate substrate 904 may not be required.

Insulating layer 906 is formed of any material such as oxide or another insulator such as a thin-film insulator. In an exemplary embodiment, insulating layer is formed of Probimide 7510 material. Insulating layer 906 suitably houses conductor 914. Conductor 914 is shown in FIGS. 9A and 9B to be a single conductor having two ends 926 and 928 arranged in a coil pattern. Alternate embodiments of conductor 914 use single or multiple conducting segments arranged in any suitable pattern such as a meander pattern, a serpentine pattern, a random pattern, or any other pattern. Conductor 914 is formed of any material capable of conducting electricity such as gold, silver, copper, aluminum, metal or the like. As conductor 914 conducts electricity, a magnetic field is generated around conductor 914 as discussed more fully below.

Cantilever (moveable element) 912 is any armature, extension, outcropping or member that is capable of being affected by magnetic force. In the embodiment shown in FIG. 9A, cantilever 912 suitably includes a magnetic layer 918 and a conducting layer 920. Magnetic layer 918 can be formulated of permalloy (such as NiFe alloy) or any other magnetically sensitive material. Conducting layer 920 can be formulated of gold, silver, copper, aluminum, metal or any other conducting material. In various embodiments, cantilever 912 exhibits two states corresponding to whether relay 900 is "open" or "closed", as described more fully below. In many embodiments, relay 900 is said to be "closed" when a conducting layer 920, connects staging layer 910 to contact 908. Conversely, the relay may be said to be "open" when cantilever 912 is not in electrical contact with contact 908. Because cantilever 912 can physically move in and out of contact with contact 908, various embodiments of cantilever 912 will be made flexible so that cantilever 912 can bend as appropriate. Flexibility can be created by varying the thickness of the cantilever (or its various component layers), by patterning or otherwise making holes or cuts in the cantilever, or by using increasingly flexible materials.

Alternatively, cantilever 912 can be made into a "hinged" arrangement. Although of course the dimensions of cantilever 912 can vary dramatically from implementation to implementation, an exemplary cantilever 912 suitable for use in a micro-magnetic relay 900 can be on the order of 10-1000 microns in length, 1-40 microns in thickness, and 2-600 microns in width. For example, an exemplary cantilever in accordance with the embodiment shown in FIGS. 9A and 9B can have dimensions of about 600 microns×10 microns×50 microns, or 1000 microns×600 microns×25 microns, or any other suitable dimensions.

Contact 908 and staging layer 910 are placed on insulating layer 906, as appropriate. In various embodiments, staging layer 910 supports cantilever 912 above insulating layer 906, creating a gap 916 that can be vacuum or can become filled with air or another gas or liquid such as oil. Although the size of gap 916 varies widely with different implementations, an exemplary gap 916 can be on the order of 1-100 microns, such as about 20 microns, Contact 908 can receive cantilever 912 when relay 900 is in a closed state, as described below. Contact 908 and staging layer 910 can be formed of any conducting material such as gold, gold alloy, silver, copper, aluminum, metal or the like. In various embodiments, contact 908 and staging layer 910 are formed of similar conducting materials, and the relay is considered to be "closed" when cantilever 912 completes a circuit between staging layer 910 and contact 908. In certain embodiments wherein cantilever 912 does not conduct electricity, staging layer 910 can be formulated of non-conducting material such as Probimide material, oxide, or any other material. Additionally, alternate embodiments may not require staging layer 910 if cantilever 912 is otherwise supported above insulating layer 906.

Principle of Operation of a Latching Switch

When it is in the "down" position, the cantilever makes electrical contact with the bottom conductor, and the switch is "on" (also called the "closed" state). When the contact end is "up", the switch is "off" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-Stability

Figure 10:
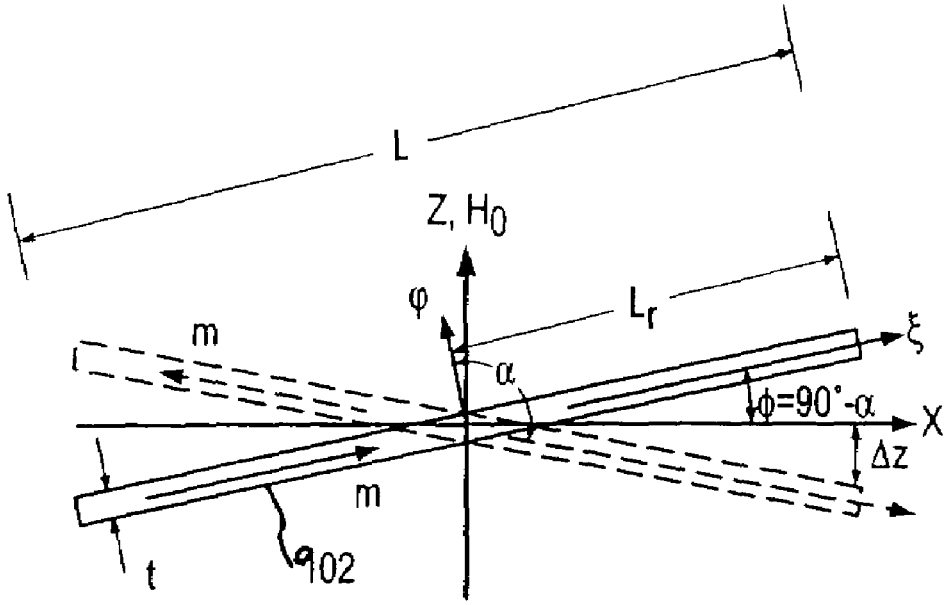
FIG. 10 illustrates the principle by which bi-stability is produced.

The principle by which bi-stability is produced is illustrated with reference to FIG. 2. When the length L of a permalloy cantilever 912 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field (H0) is smaller than 90°, the torque is counterclockwise; and when $\alpha$ is larger than 90°, the torque is clockwise. The bi-directional torque arises because of the bi-directional magnetization (i.e., a magnetization vector "m" points one direction or the other direction, as shown in FIG. 10) of the cantilever (m points from left to right when $\alpha<90°$, and from right to left when $\alpha>90°$). Due to the torque, the cantilever tends to align with the external magnetic field (H0). However, when a mechanical force (such as the elastic torque of the cantilever, a physical stopper, etc.) preempts to the total realignment with H0, two stable positions ("up" and "down") are available, which forms the basis of latching in the switch.

(ii) Electrical Switching

If the bi-directional magnetization along the easy axis of the cantilever arising from H0 can be momentarily reversed by applying a second magnetic field to overcome the influence of (H0), then it is possible to achieve a switchable latching relay. This scenario is realized by situating a planar coil under or over the cantilever to produce the required temporary switching field. The planar coil geometry was chosen because it is relatively simple to fabricate, though other structures (such as a wrap-around, three dimensional type) are also possible. The magnetic field (Hcoil) lines generated by a short current pulse loop around the coil. It is mainly the $\xi$-component (along the cantilever, see FIG. 10) of this field that is used to reorient the magnetization (magnetization vector "m") in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component [$H0\xi \sim H0\cos(\alpha)=H0\sin((\phi), \alpha=90°-\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bi-stable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

| | |
|---|---|
| $B2 \cdot n = B1 \cdot n$, | $B2 \times n = (\mu 2/\mu 1)\, B1 \times n$ |
| or | |
| $H2 \cdot n = (\mu 1/\mu 2)\, H1 \cdot n$, | $H2 \times n = H1 \times n$ |

Figure 11:
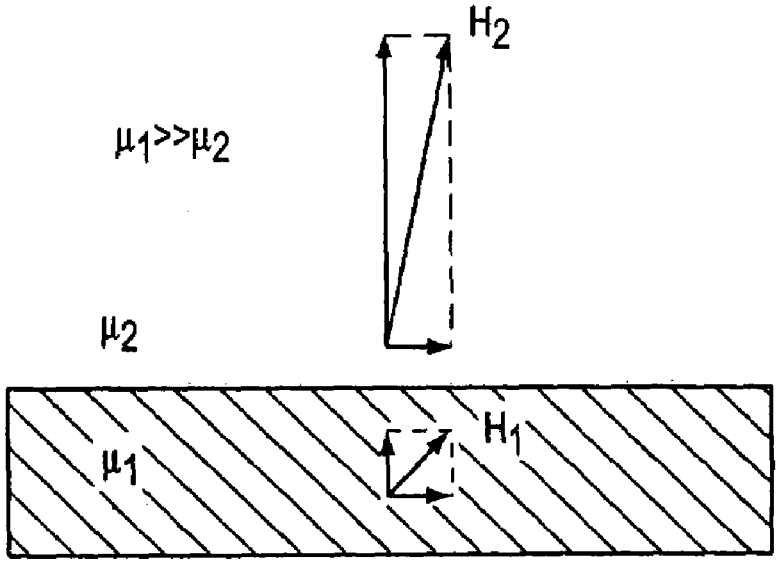
FIG. 11 illustrates the boundary conditions on the magnetic field (H) at a boundary between two materials with different permeability (1>>2).

If $\mu 1 >> \mu 2$, the normal component of H2 is much larger than the normal component of H1, as shown in FIG. 11. In the limit $(\mu 1/\mu 2) \rightarrow \infty$, the magnetic field H2 is normal to the boundary surface, independent of the direction of H1 (barring the exceptional case of H1 exactly parallel to the interface). If the second media is air ($\mu 2=1$), then $B2=\mu 0\, H2$, so that the flux lines B2 will also be perpendicular to the surface. This property is used to produce magnetic fields that are perpendicular to the horizontal plane of the cantilever in a micro-magnetic latching switch and to relax the permanent magnet alignment requirements.

This property, where the magnetic field is normal to the boundary surface of a high-permeability material, and the placement of the cantilever (i.e., soft magnetic) with its horizontal plane parallel to the surface of the high-permeability material, can be used in many different configurations to relax the permanent magnet alignment requirement.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A method of assembling a laminated electro-mechanical structure, comprising:

(a) stacking a plurality of planar structural layers to form a stack, wherein the plurality of planar structural layers has a first planar structural layer having a movable element formed therein;

(b) attaching each planar structural layer of the stack to an adjacent planar structural layer of the stack; and (c) prior to step (a), forming the plurality of planar structural layers, wherein the laminated electro-mechanical structure includes a latching switch, comprising:

forming at least one electronic component on a surface of a planar structural layer of the plurality of planar structural layers; and electrically coupling the at least one electronic component to the latching switch.

2. The method of claim 1, wherein step (a) comprises:

aligning the planar structural layers in the stack.

3. The method of claim 1, wherein said stacking step comprises:

positioning a further planar structural layer having a permanent magnet in the stack.

4. The method of claim 1, wherein said stacking step comprises:

positioning a further planar structural layer having a high permeability magnetic material in the stack.

5. The method of claim 1, wherein said stacking step comprises:

positioning a further planar structural layer having at least a portion of an electromagnet in the stack.

6. The method of claim 1, wherein said stacking step comprises:

positioning in the stack a further planar structural layer having at least one electrical contact area formed thereon.

7. The method of claim 1, wherein said stacking step comprises:

positioning the first planar structural layer having the movable element in the stack.

8. The method of claim 7, wherein said stacking step further comprises:

positioning in the stack a second planar structural layer having an opening therethrough to form a cavity.

9. The method of claim 8, wherein said second planar structural layer positioning step comprises:

positioning the second planar structural layer in the stack adjacent to the first planar structural layer such that the movable element moves in the cavity during operation of the movable element.

10. The method of claim 1, wherein said forming step comprises:

forming the movable element in the first planar structural layer so that the movable element is capable of moving in a plane that is coplanar with the first planar structural layer.

11. The method of claim 1, wherein said forming step comprises:

forming the movable element in the first planar structural layer so that the movable element is capable of moving outside of a plane that is coplanar with the first planar structural layer.

12. The method of claim 1, wherein step (b) comprises:

prior to step (a), applying an adhesive material to at least one opposing surface of each pair of adjacent planar structural layers of the stack.

13. The method of claim 12, wherein the adhesive material is an epoxy, wherein said applying step comprises:

applying the epoxy to the at least one opposing surface of each pair of adjacent planar structural layers of the stack.

14. The method of claim 13, wherein step (b) further comprises:

after step (a), curing the epoxy applied to the at least one opposing surface of each pair of adjacent planar structural layers of the stack.

15. The method of claim 14, wherein said curing step comprises:

heating the stack to cure the epoxy.

16. The method of claim 1, wherein the at least one electrical component includes at least one of an inductor, a capacitor, and a resistor, wherein said electronic component forming step includes:

forming the at least one of an inductor, a capacitor, and a resistor on the surface of the planar structural layer of the plurality of planar structural layers.

17. The method of claim 1, wherein step (c) comprises:

forming a planar structural layer that includes a permanent magnet.

18. The method of claim 1, wherein step (c) comprises:

forming a planar structural layer that includes a high permeability magnetic material.

19. The method of claim 1, wherein step (c) comprises:

forming a planar structural layer that includes at least a portion of an electromagnet.

20. The method of claim 1, wherein step (c) comprises:

forming at least one electrical contact area on a surface of a planar structural layer.

21. The method of claim 1, wherein step (c) comprises:

forming a planar structural layer having an opening therethrough.

22. The method of claim 1, wherein step (c) comprises:

forming the first planar structural layer having the movable element.

23. The method of claim 22, wherein said step of forming the first planar structural layer comprises:

forming the movable element in the first planar structural layer; and forming at least one flexure portion in the first planar structural layer that is mechanically coupled to the movable element.

24. The method of claim 22, wherein said step of forming the first planar structural layer comprises:

forming at least one contact area in the first planar structural layer that is electrically coupled to the movable element.

25. The method of claim 1, wherein the laminated electro-mechanical structure includes a latching switch, wherein step (c) comprises:

forming an antenna pattern on a surface of a planar structural layer of the plurality of planar structural layers; and electrically coupling the antenna pattern to the latching switch.

26. A method of assembling a laminated electro-mechanical structure, comprising:

(a) stacking a plurality of planar structural layers to form a stack, wherein the plurality of planar structural layers has a first planar structural layer having a movable element formed therein;

(b) attaching each planar structural layer of the stack to an adjacent planar structural layer of the stack; and (c) prior to step (a), forming the plurality of planar structural layers, comprising:

forming a planar structural layer having an opening therethrough, comprising:

forming the movable element in the first planar structural layer; and forming at least one flexure portion in the first planar structural layer that is mechanically coupled to the movable element.

* * * * *